United States Patent [19]

Fuller

[11] 4,216,907

[45] Aug. 12, 1980

[54] HYDRAULIC GUN

[76] Inventor: Robert J. Fuller, 520 N.E. 104th Ave., Vancouver, Wash. 98664

[21] Appl. No.: 876,470

[22] Filed: Feb. 9, 1978

[51] Int. Cl.[2] ..... B05B 9/00

[52] U.S. Cl. ..... 239/127; 137/881; 239/526

[58] Field of Search ..... 137/881; 239/127, 526

[56] References Cited

U.S. PATENT DOCUMENTS

| | | | |
|---|---|---|---|
| 2,844,408 | 7/1958 | Dickmann et al. | 239/526 X |
| 3,147,767 | 9/1964 | Goss | 239/127 |
| 3,690,558 | 9/1972 | Tuttle | 239/127 |
| 3,765,607 | 10/1973 | Pacht | 239/124 |
| 3,802,628 | 4/1974 | Goss et al. | 239/527 X |
| 3,885,739 | 5/1975 | Tuttle | 239/526 X |
| 3,986,523 | 10/1976 | Pacht | 137/882 |

*Primary Examiner*—Gerald A. Michalsky
*Attorney, Agent, or Firm*—Klarquist, Sparkman, Campbell, Leigh, Hall & Whinston

[57] ABSTRACT

A hydraulic gun includes a gun body within which a trigger operated valve and a second, pressure operated valve are supplied with water under pressure from a pump. The trigger operated valve is normally open and returns water at a comparatively low pressure to a water reservoir, but when the trigger operated valve is closed, the water pressure opens the second valve, through which water is delivered to a nozzle.

8 Claims, 4 Drawing Figures

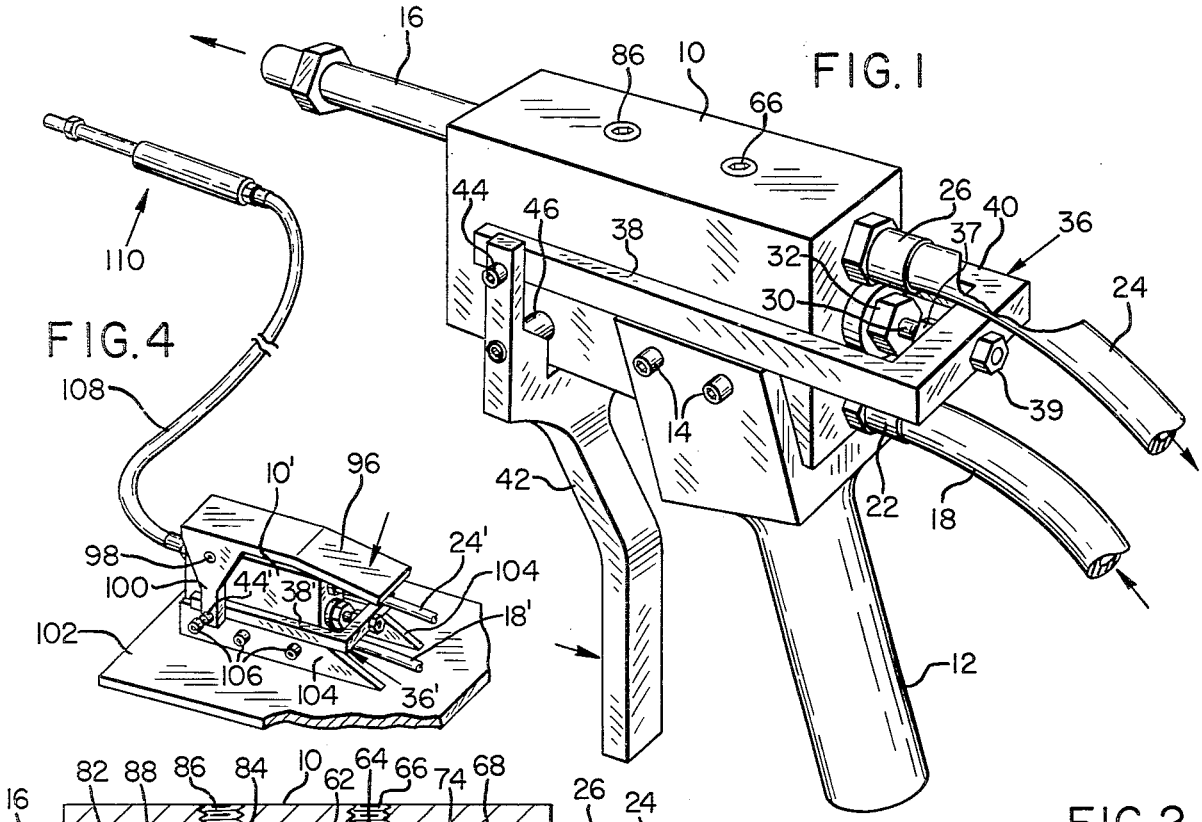
FIG. 1
FIG. 4
16
86
10
66
44
46
38
26
40
37
36
32
30
24
39
14
42
22
18
12
110
108
10'
96
98
100
44'
38'
24'
104
18'
102
106
104
36'
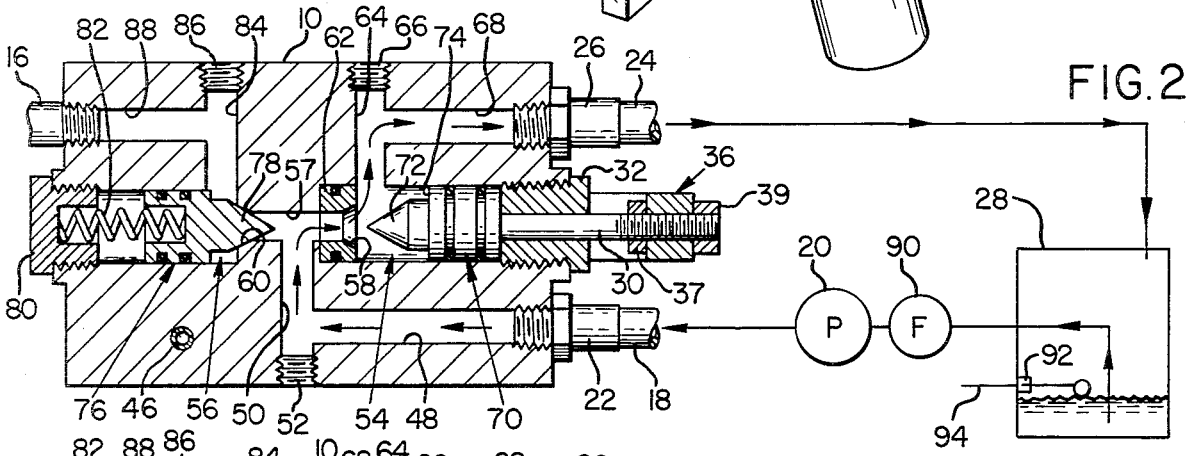
FIG. 2
16
82
88
86
84
10
62
64
66
74
68
26
24
78
57
72
32
36
39
28
20
90
80
60
58
30
37
P
F
92
76
46
56
50
52
54
48
70
22
18
94
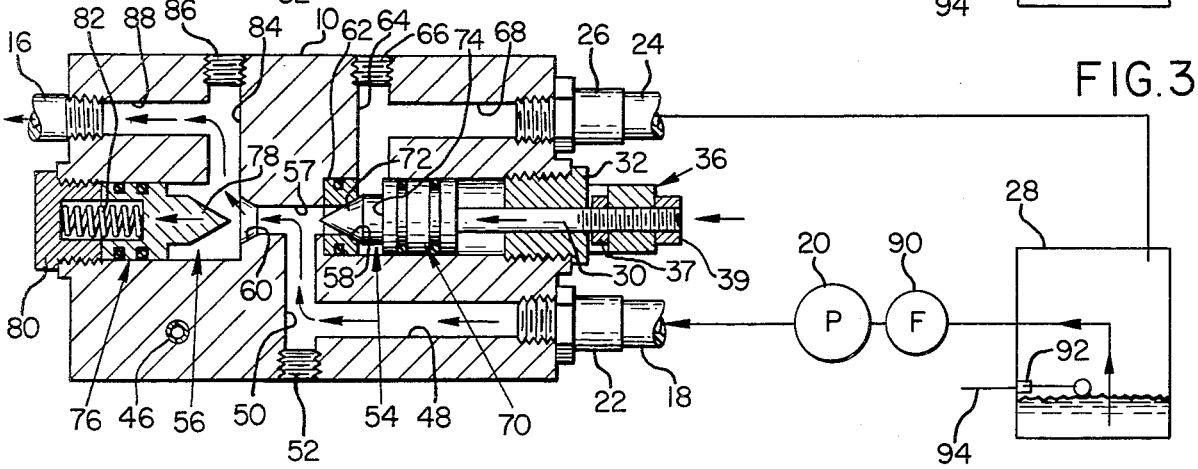
FIG. 3
16
82
88
86
84
10
62
64
66
74
68
26
24
78
57
72
32
36
28
20
90
80
60
58
30
37
39
P
F
92
76
46
56
50
52
54
48
70
22
18
94

HYDRAULIC GUN

BACKGROUND OF THE INVENTION

The present invention relates to a hydraulic gun and particularly to a hydraulic gun adapted to return water to the source when not operated.

Hydraulic gun devices are available for delivering a jet of water through a restricted nozzle at high pressure for the purpose of cleaning various surfaces by means of the water jet alone or through use of sand or abrasives introduced into the water jet. These devices customarily include a normally open, trigger operated valve which dumps the flow of water on the ground until such time as the valve is closed and the water is forced to exit at high pressure through a restricted nozzle. In the non-operated condition of the gun, not only does water exit through the dump port, representing a considerable waste, but water also exits to a certain degree through the gun nozzle obscuring the operator's view of the surface or item being cleaned.

Reduction of water outflow in the non-operated gun condition is possible through elimination of the water dump port and provision of an unloading system in connection with the water supply pump. Thus, a return is made around the pump when a predetermined high pressure level is reached. However, the unloading device represents an additional item of equipment and expense, and the pump continues to operate at a high pressure, while there may still be leakage from the nozzle. Another device employs an electrical circuit for reducing pump pressure when the trigger is not operated, but this also represents an additional expense without elimination of water leakage.

SUMMARY OF THE INVENTION

In accordance with the present invention, a recirculation system is included within the gun and operates at a comparatively low pressure for eliminating water dumping as well as leakage from the gun's nozzle. A gun body is provided with a trigger, a first normally open trigger operated valve, and a second normally closed pressure operated valve adapted to open at a predetermined pressure substantially smaller than the operating pressure of the gun. A first passage in the gun body couples inlet water to both valves, while a conduit means normally couples the outlet of the first valve to a water reservoir. Another passage connects the outlet of the second valve to a nozzle member such that water is not expelled through the nozzle member until the second valve is open. When the trigger operated valve is closed, the passage to the reservoir is shut off and the second valve opens supplying water under pressure to the nozzle member. No water normally escapes through either a dump port or a nozzle member onto the ground, nor is cumbersome unloading equipment exterior to the gun required.

It is accordingly an object of the present invention to provide an improved hydraulic gun for operation under conditions where the expulsion of large quantities of water in the non-operated condition is objectionable.

It is another object of the present invention to provide an improved hydraulic gun that can be conveniently shut off by the operator.

It is another object of the present invention to provide an improved hydraulic gun for returning supply water to the source when not in use.

It is another object of the present invention to provide an improved hydraulic gun characterized by ease of operation and economy of construction.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a perspective view of a hydraulic gun according to a first embodiment of the present invention;

FIG. 2 is a vertical cross section taken through the body of the FIG. 1 gun in its non-operated or trigger-open condition;

FIG. 3 is a vertical cross section of the FIG. 1 gun in its operated or trigger-closed condition; and FIG. 4 is a perspective view of a foot-operated hydraulic gun in accordance with the second embodiment of the present invention.

DETAILED DESCRIPTION

Referring to the drawings and particularly to FIG. 1, a hydraulic gun according to the present invention includes a rectangular gun body 10 suitably formed from a block of aluminum or stainless steel and having a lower fork-shaped handgrip 12 mounted thereon by means of screws 14 extending into the body 10 through holes in the upper fork-shaped portion of the handgrip. A nozzle 16 which may comprise a conduit closed at the forward end except for a small orifice is threadably received into the upper forward end of the gun body. A conduit or hose 18 delivers water under pressure from a positive displacement pump 20 (FIGS. 2 and 3) and is connected at the lower rear end of the gun body by means of fitting 22, while a second conduit or hose 24 is joined to the upper rearward end of the gun body by means of fitting 26 and is adapted to return water to a reservoir 28. Water is supplied to the reservoir from water main 94 through float valve 92, and is withdrawn therefrom by pump 20 via filter 90. (FIGS. 2 and 3)

A trigger-operated valve stem 30 extends rearwardly through a fitting 32 at the central rear end of the gun body, and through an aperture in the end of U-shaped yoke 36 to which the stem is threadably secured employing nuts 37 and 39 forward and rearward of yoke 36. The yoke 36 includes a pair of forward arms 38 and 40 located along the sides of the gun body above grip 12 and pivotally joined to the upper part of fork-shaped trigger lever 42 by means of screws 44 threadably engaging arms 38 and 40 through apertures in the upper fork-shaped portion of trigger lever 42. Grip 12, U-shaped yoke 36 and trigger lever 42 are suitably formed of cast aluminum.

A roll pin 46 extends through body 10 from side to side and pivotally engages trigger lever 42 between arms 38 and 40 and the lower handle portion of the trigger lever. Therefore, when the trigger handle is urged rearwardly in the direction of grip 12 as by hand grasp, the U-shaped yoke 36 is urged forwardly against valve stem 30. It is noted there is a mechanical advantage in providing a relatively longer handle for trigger lever 42, while arms 38 and 40 are joined to the trigger lever a short distance above roll pin 46.

Referring more particularly to the interior of gun body 10, reference is made to FIGS. 2 and 3 respectively illustrating the gun in a trigger-open condition and a trigger-closed condition. Conduit 18 from positive displacement pump 20 delivers water via threaded fitting 22 at the lower rear of body 10 to a horizontal passage 48 within the body. Passage 48 terminates in a vertical passage 50 closed at its lower extremity by means of plug 52 and leading to the upstream side of a first poppet valve 54 and a second poppet valve 56 via a short horizontal channel 57. Passages 48 and 50 and channel 57 form a first inlet passage according to the present invention. The upstream or high pressure side of each of the valves is provided with a valve seat, numbered 58 in the case of valve 54 and numbered 60 in the case of valve 56. The valve seat 58 of valve 54 is formed in a hardened steel insert 62. For the condition of the valves as shown in FIG. 2, the water flow is indicated by the arrows, through valve 54 to a second passage inside the gun body comprising a vertical passage portion 64, adjacent valve seat 58, joining horizontal portion 68 extending to receive threaded coupling 26 at the upper rearward end of the gun body. Vertical portion 64 is closed by a plug 66.

Valve 54 further includes a valve member, head or poppet 70 slidably received from the rearward end of the body in a central, horizontal cylindrical bore closed by fitting 32. The valve member 70 is provided with O-ring seals between the member and the receiving bore. The forward end 72 of the valve member is smaller in diameter, having a flat annular end 74 therearound while the forward tip of end 72 is conical in shape, including a total angle of approximately 60° for mating with matching 60° conical valve seat 58. This shape is found to be of advantage in closing valve 54 as when valve stem 30 is urged forwardly by yoke 36.

Valve 56 includes valve member, head or poppet 76 and seat 60 which advantageously have the same shape as discussed with respect to valve 54. Again, the forward valve end 78 as well as the valve seat 60, are preferably conically shaped and include a total angle of approximately 60°. However, the valve member 76 is received in a horizontal bore extending from the forward end of the gun body closed with plug 80 which forces a compression spring 82 against the rearward end of valve member 76, the latter having a cylindrical aperture for receiving the end of the spring. The spring pressure is such that valve 56 will open, i.e., valve member 76 will move to the left, when the water pressure against forward end 78 exceeds about 150 p.s.i.

A third passage in the gun body which leads from the outlet of valve 56 comprises a vertical portion 84 adjacent valve seat 60, joined to horizontal portion 88 extending to the upper forward end of the gun body into which nozzle 16 is threadably received. The upper end of vertical portion 84 is closed by plug 86. It is seen the various passages in solid metal body 10 are formed by drilling perpendicularly thereinto and plugging extra passage openings.

For the position of the valves shown in FIG. 2, there is substantially no communication of water through valve 56 inasmuch as the water pressure within passage 50 is below 150 p.s.i. Rather, the water returns to a reservoir 28 through conduit 24, as hereinbefore mentioned, from which it is withdrawn by pump 20 through filter 90. Water is returned at comparatively low pressure to the reservoir rather than onto the ground, and is prevented from discharging to any substantial degree through nozzle 16 because of valve 56.

Thus, large quantities of water are not dumped through the gun to the ground in accordance with the usual practice, nor is there any substantial leakage or dribble through the nozzle. Instead, the nozzle is closed off and water is recirculated through the gun back to the reservoir. Moreover, as indicated, pressure within the gun at this time is low, e.g., below 150 p.s.i., and no high pressure bypass unloading mechanism is required at the pump.

When valve stem 30 is urged to the left, as illustrated in FIG. 3 by action of trigger lever 42, the valve member 70 which is attached to valve stem 30 and particularly forward end 72 of the valve member becomes seated against valve seat 58 shutting off the water return through conduit 24. The valve closure operates smoothly and easily due to the lower pressure, the shape of forward end 72, and the action of valve 56 in opening. When valve 54 closes, the positive displacement pump 20 provides pressure above 150 p.s.i., driving valve member 76 to the left causing the water to flow through the third passage and out nozzle 16 as indicated by the arrows in FIG. 3.

The gun is, of course, operated for the purpose of directing a high pressure spray of water from nozzle 16 which immediately builds up due to the action of pump 20. This condition continues until trigger lever 42 is released whereupon water again returns through valve 54 and conduit 24 to the reservoir, the pressure dropping and allowing valve 56 to close for discontinuing the flow of water from the nozzle.

A further embodiment according to the present invention is illustrated in FIG. 4, wherein corresponding elements are indicated by primed reference numerals. The hydraulic gun in this case is intended for foot operation, and accordingly the gun body 10′ is mounted on a lower support plate 102 for placement on the floor or ground. Side brackets 104 secured to the support plate are joined to the gun body by means of screws 106. Upwardly extending trigger lever 100 is pivoted to gun body 10′ upon a roll pin 98 projecting from the upper forward corner of the gun body, with the trigger lever further including a treadle 96 extending horizontally rearwardly from above roll pin 98 to form a downwardly angled rear portion having a long lever arm. Below roll pin 98, trigger lever 100 is pivotally joined to forward arms of yoke 36′ by screws 44′ threadably engaging the forward yoke arms through apertures in trigger lever 100. Therefore, as foot pressure is applied in a downward direction against treadle 96, the trigger lever 100 pivots in a clockwise direction about roll pin 98, urging yoke 36′ forwardly for operating the hydraulic gun in the hereinbefore described manner. The interior of the gun body is suitably substantially identical to the construction hereinbefore described in connection with FIGS. 2 and 3, and operates in a substantially identical manner. However, instead of the nozzle being directly joined to gun body 10′, a portable nozzle 110 is joined to the third interior passage in the gun body via a conduit or hose 108.

While I have shown and described preferred embodiments of my invention, it will be apparent to those skilled in the art that many changes and modifications may be made without departing from our invention in its broader aspects. I therefore intend the appended claim to cover all such changes and modifications as fall within the true sprit and scope of my invention.

I claim:

1. A hydraulic gun for directing a stream of water at high pressure, said gun comprising:

a gun body provided with a first valve having an upstream side including a seat and a downstream side including a valve head adapted to close against said seat to close said first valve, said first valve having a valve stem extending rearwardly through an end of said gun body, and a second valve having an upstream side including a seat and a downstream side including a valve head adapted to close against the last mentioned seat to close the second valve, trigger means for closing said valve head of said first valve towards the corresponding seat, said trigger means comprising a forked lever pivotally supported at sides of said gun body with the forked end of said lever being disposed on either side of said gun body, and a U-shaped yoke attached at its closed end to said valve stem and having arms extending along said gun body and pivotally engaging the forked end of said lever, spring biasing means urging the valve head of said second valve toward the corresponding seat, said gun body having a first inlet passage for receiving water under pressure from a pump, said inlet passage being coupled to the upstream side of both said first and second valves, a water supply reservoir for said pump and conduit means for coupling the water reservoir inlet to the gun body, said gun body including a second passage for coupling the downstream side of said first valve to said conduit means for returning water to said reservoir, and a third passage in said gun body for coupling the downstream side of said second valve to a nozzle having a restricted orifice.

2. The apparatus according to claim 1 wherein each of said valves comprises a poppet valve wherein the valve head therof is conical in shape for mating with a substantially conical seat, both said valve head and said seat describing an angle of approximately 60°.

3. The apparatus according to claim 2 wherein said first valve is provided with a hardened metal seat.

4. The apparatus according to claim 1 wherein said gun body is provided with a grip extending downwardly therefrom, and wherein said lever also extends downwardly for drawing toward said grip and actuating said gun.

5. The apparatus according to claim 1 wherein said lever extends upwardly and is provided at its upper end with a substantially right angle portion forming a foot-operated treadle above the body of said gun.

6. A hydraulic gun for directing a stream of water at high pressure, said gun comprising:

a gun body provided with a first valve having an upstream side including a seat and a downstream side including a valve head adapted to close against said seat to close said first valve, and a second valve having an upstream side including a seat and a downstream side including a valve head adapted to close against the last mentioned seat to close the second valve, said gun body having a forward end and a rearward end, trigger means for closing said valve head of said first valve towards the corresponding seat, and spring biasing means urging the valve head of said second valve toward the corresponding seat, said gun body having a first inlet passage for receiving water under pressure from a pump, said first inlet passage being coupled to the upstream side of both said first and second valves and extending through the rearward end of said body to receive a conduit means connected to said pump, a water supply reservoir for said pump and further conduit means for coupling the water reservoir inlet to the gun body, said gun body including a second passage coupled to the downstream side of said first valve and extending through the rearward end of said body to receive said further conduit means for returning water to said reservoir, a third passage in said gun body coupled to the downstream side of said second valve and extending to the forward end of said gun body, and a nozzle member having a restricted orifice received in said third passage.

7. A hydraulic gun for providing water under pressure, said hydraulic gun comprising:

a unitary gun body adapted to be hand held, having a manually operated trigger lever pivotally mounted on said gun body, a nozzle member rigidly secured to said gun body for delivering a stream of water to the exterior environment, and valving means within said gun body operated by said trigger lever for controlling water supplied to said nozzle member, a water reservoir and a pump associated therewith and receiving water therefrom for delivering water under pressure to said gun body, said gun body having a first interior passage for receiving water from said pump, a second interior passage for returning water to said reservoir when said trigger lever is not operated, and a third interior passage coupled to said nozzle member for delivering water under pressure thereto when said trigger lever is operated, and first and second hoses wherein the first said hose connects said first passage in said gun body to said pump, and the second said hose connects said second passage in said gun body to said reservoir, said valving means within said gun body comprising a first valve disposed between said first and second passages having an upstream side communicating with said first passage including a seat and a downstream side including a valve head adapted to close against said seat for closing said first valve, said first valve having a valve stem attached to said valve head and extending rearwardly through an end of said gun body for operative connection with said trigger lever to close said valve head against said seat and close off return of water to said second passage in response to manual operation of said trigger lever, and a second valve located between said first passage and said third passage, said second valve having an upstream side communicating with said first passage including a seat and a downstream side including a valve head adapted to close against the last mentioned seat to close the second valve, and biasing means for normally closing the head of said second valve against the corresponding seat for water pressures under a predetermined value, said second valve opening to provide water to said third passage and said nozzle member in consequence of pressure increase when said first valve is closed, said trigger lever comprising a forked lever pivotally supported at the sides of said gun body with the forked end of said lever being disposed on either side of said gun body, and a U-shaped yoke attached at its closed end to said valve stem of said first valve where it extends rearwardly through an end of said gun body, said U-shaped yoke having arms extending along said gun body and pivotally engaging the forked end of said lever.

8. A hydraulic gun for providing water under pressure, said hydraulic gun comprising:

a unitary gun body adapted to be hand held, having a manually operated trigger lever pivotally mounted on said gun body, a nozzle member rigidly secured to said gun body for delivering a stream of water to the exterior environment, and valving means within said gun body operated by said trigger lever for controlling water supplied to said nozzle member, a water reservoir and a pump associated therewith and receiving water therefrom for delivering water under pressure to said gun body, said gun body having a first interior passage for receiving water from said pump, a second interior passage for returning water to said reservoir when said trigger lever is not operated, and a third interior passage coupled to said nozzle member for delivering water under pressure thereto when said trigger lever is operated, and first and second hoses extending from apertures rearwardly of said gun body wherein the first said hose connects said first passage in said gun body to said pump, and the second said hose connects said second passage in said gun body to said reservoir, said valving means within said gun body comprising a first valve disposed between said first and second passages having an upstream side communicating with said first passage including a seat and a downstream side including a valve head adapted to close against said seat for closing said first valve, said first valve having a valve stem attached to said valve head and extending exteriorly from said gun body for operative connection with said trigger lever to close said valve head against said seat and close off return of water to said second passage in response to manual operation of said trigger lever, and a second valve located between said first passage and said third passage, said second valve having an upstream side communicating with said first passage including a seat and a downstream side including a valve head adapted to close against the last mentioned seat to close the second valve, and biasing means for normally closing the head of said second valve against the corresponding seat for water pressures under a predetermined value, said second valve opening to provide water to said third passage and said nozzle member in consequence of pressure increase when said first valve is closed, said gun body being provided with a grip extending downwardly therefrom, said trigger lever also extending downwardly for drawing toward said grip and actuating said gun.

* * * * *